United States Patent [19]

Sawada

[11] Patent Number: 4,689,450

[45] Date of Patent: Aug. 25, 1987

[54] MOTOR SWITCH

[75] Inventor: Kenji Sawada, Furukawa, Japan

[73] Assignee: Alps Electric Co., Ltd., Japan

[21] Appl. No.: 864,701

[22] Filed: May 19, 1986

[30] Foreign Application Priority Data

May 17, 1985 [JP] Japan ..... 60-73135[U]

[51] Int. Cl.[4] ..... H01H 21/00

[52] U.S. Cl. ..... 200/6 R; 200/68.3

[58] Field of Search ..... 200/6 R, 6 B, 6 BA, 200/6 BB, 6 C, 68.1, 68.2, 68.3, 73, 333, 339, 335

[56] References Cited

U.S. PATENT DOCUMENTS

| | | | |
|---|---|---|---|
| 3,254,163 | 5/1966 | Wanlass | 200/6 B |
| 3,299,224 | 1/1967 | DeLorme et al. | 200/6 B |
| 3,462,564 | 8/1969 | Bedocs | 200/16 C |
| 3,681,556 | 8/1972 | Osika | 200/338 |
| 3,701,870 | 10/1972 | Sorenson | 200/68.3 X |
| 4,241,244 | 12/1980 | Swann | 200/68.3 X |
| 4,367,386 | 1/1983 | Sorenson | 200/339 X |

*Primary Examiner*—J. R. Scott

*Attorney, Agent, or Firm*—Guy W. Shoup

[57] ABSTRACT

A switch adapted for automotive power window comprises a wafer, stoppers extending upwardly from the wafer, an operation member for actuating movable elements and a knob extending upwardly from the operation member. Each of the stoppers has a recess at the center of its upper portion. The operation member extends over these recesses. A cap of either lever type or seesaw type can be mounted on the knob, whereby the switch can be manufactured either as lever type or as seesaw type.

4 Claims, 4 Drawing Figures

MOTOR SWITCH

FIELD OF THE INVENTION

The present invention relates to a switch for a motor and, more particularly, to a switch for an automotive power window.

BACKGROUND OF THE INVENTION

Heretofore, the type of each individual switch of this kind has been determined first. It is necessary that each switch be manufactured as lever type or seesaw type according to the demand. Further, stoppers for an operation member used in a switch have been required to be fabricated separately for each type of switch.

SUMMARY OF THE INVENTION

It is an object of the invention to provide a switch for motor, the switch being free of the foregoing difficulties with the prior art techniques.

It is a more specific object of the invention to provide a switch which can be manufactured as any desired type without modifying the body of the switch, is simple in structure and easy to assemble, and has operation member stoppers that can accommodate themselves to any switch type.

These objects are achieved in accordance with the teachings of the invention by a switch comprising: a wafer; a pair of barriers extending upwardly from the wafer and acting also as stoppers; a connector member connected to fixed contacts for switching operation, the connector member being held between the barriers; a knob extending upwardly from, and formed integrally with, the operation member; and a cap detachably mounted on the knob, whereby the switch can be manufactured either as lever type or as seesaw type.

DETAILED DESCRIPTION OF THE INVENTION

Figure 1:
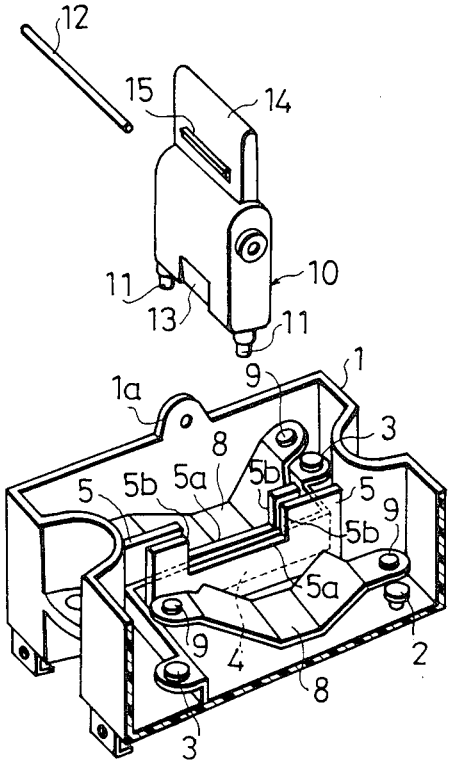
FIG. 1 is a partially cutaway, exploded perspective view of the wafer of a motor switch according to the invention.
Figure 2:
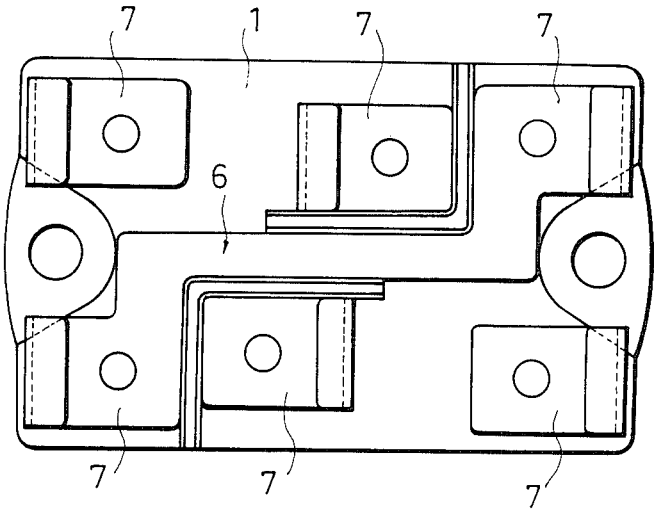
FIG. 2 is a bottom view of the wafer shown in FIG. 1.
Figure 3:
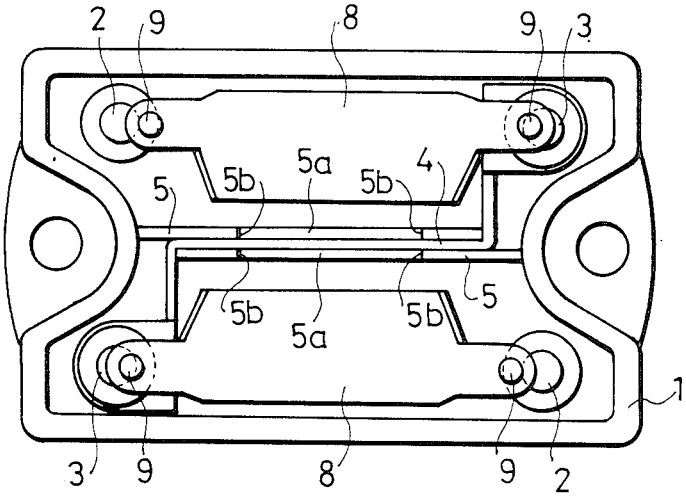
FIG. 3 is a plan view of the wafer shown in FIGS. 1 and 2 under the condition that its operation member has been removed.

Referring to the drawings, there is shown a switch which is manufactured in accordance with the invention and which is used for a motor. This switch has a wafer 1 having an opening on its upper side. A pair of fixed contacts 2 for energization is rigidly secured to the bottom of the wafer 1. Also, a pair of fixed contacts 3 used for switching purposes is firmly mounted to the bottom of the wafer 1. The contacts 2 are disposed in a diametrically opposite relation with respect to the center of the bottom of the wafer. Also, the contacts 3 are disposed in a diametrically opposite relation with respect to the center of the bottom. The contacts 3 are connected together by a crank-shaped connector member 4 within the wafer 1. The connector member 4 has a straight plate portion, and barriers 5 which extend upwardly from the bottom of the wafer 1 are disposed on opposite sides of the straight plate portion such that this plate portion is held between the barriers 5. On the reverse side of the bottom of the wafer 1, the fixed contacts 2 are also connected together by a crank-shaped connector member 6. Fixed connecting terminals 7 whose front ends are bent to prevent lead wires from breaking are firmly fixed to the reverse side of the bottom of the wafer 1.

Substantially V-shaped movable elements 8 are mounted outside the barriers 5. Movable contacts 9 are rigidly fixed to both ends of each movable element 8. These movable elements 8 are actuated by an operation member 10 that is provided with driver rods 11 at opposite sides of the lower end. The front end of each rod 11 is spherical in shape. Each rod 11 is biased by a compressed spring 18. The operation member 10 is so arranged as to extend over recesses 5*a* formed in each center of the upper portions of the barriers 5. A shaft 12 extends through the operation member 10, and is mounted to support portions 1*a* protruding from each center of the upper lateral sides of the wafer 1 so that the member 10 may rotate about the shaft 12.

Figure 4:
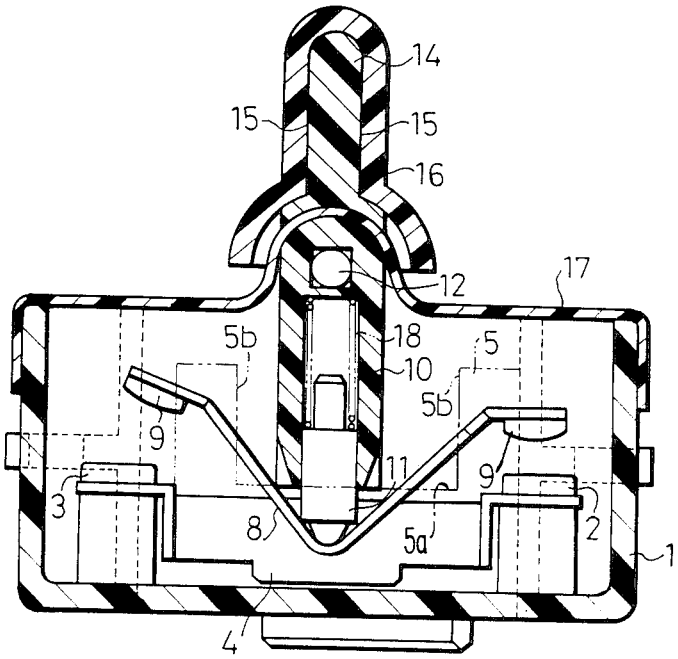
FIG. 4 is a cross-sectional view of the motor switch under the condition that it has been assembled.

The operation member 10 is further provided with tapering abutting portions 13 at the center of the lower surface of the member. As the operation member 10 is tilted, either one of the abutting portions 13 abuts against corresponding ones of stopper portions 5*b* formed in neighboring relation to the recesses 5*a* of the barriers 5, whereby the operation member 10 can no longer move. A knob 14 extends upwardly from and is formed integrally with the operation member 10. The knob 14 is provided with anchoring protrusions 15 on its both sides. A cap 16 (see FIG. 4) can be detachably mounted on the knob 14 with a press fit. In this specific example, the cap 16 is of lever type. If a cap of seesaw type is mounted instead of the cap of lever type, the type of switch can be changed without modifying the body of the switch. A waterproof casing 17 is made from rubber.

As described thus far, in accordance with the present invention, any desired cap can be mounted on the knob. Hence, it can be made either as lever type or as seesaw type without modifying the body of the switch. Further, since the barriers serve as stoppers, there is no need to form stoppers independently. Consequently, the novel switch is simple in structure and easy to assemble.

What is claimed is:

1. A switch comprising:

a wafer made of insulative material having a bottom and side walls forming a rectangular enclosure having longitudinal and lateral dimensions;

a stopper wall disposed longitudinally in said rectangular enclosure and extending upright from the bottom of said wafer, said stopper wall having an upper portion with a central recess formed therein, said central recess being formed by a first upright side, an intermediate longitudinal portion at a recessed depth, and a second upright side opposite said first upright side;

a pair of fixed contacts disposed on each side longitudinally in the bottom of said wafer;

a movable element arranged longitudinally in the bottom of said wafer and laterally to one side of said stopper wall, said movable element having movable contacts on each end thereof, each movable contact being engageable with a respective one of said fixed contacts when said movable element is moved in one or the opposite longitudinal direction;

an operation member for actuating said movable element which is pivotably mounted to the side walls on an upper portion of said wafer, said member having an upper operation end and a lower driving end which is pivotable in one or the opposite longitudinal directions;

said lower driving end of said operation member having a driver portion engaged with said movable element, and a tapered abutting portion disposed swingably in said central recess of said stopper wall, said abutting portion being swingable with pivoting of said operation member so as to abut against said first and said second upright sides of said stopper wall in the respective longitudinal directions so as to define the limits of the pivoting movement of said operation member.

2. A switch according to claim 1, wherein said stopper wall is arranged longitudinally in the center of said wafer, and said switch further comprising two movable elements one on each side laterally of said support wall, each movable element having movable contacts on each end thereof, and two pairs of fixed contacts one pair on each side laterally of said support wall disposed so as to be engageable with the respective movable contacts of said movable elements.

3. A switch according to claim 2, wherein said support wall is formed by two spaced apart support wall portions defining a longitudinal channel inbetween, said switch further comprising a crank-shaped connector member having an intermediate section held in said channel and opposite ends connected to and supporting the fixed contacts which are diagonally opposite each other in said wafer.

4. A switch according to claim 1, wherein said upper operations end of said operation member has a cap detachably mounted thereon.

* * * * *